United States Patent [19]

Azema et al.

[11] 4,306,216

[45] Dec. 15, 1981

[54] VARIABLE RESISTOR WITH CLICK MECHANISM

[75] Inventors: Tadamitsu Azema; Mayumi Sato, both of Miyagi, Japan

[73] Assignee: Alps Electric Co., Ltd., Tokyo, Japan

[21] Appl. No.: 172,413

[22] Filed: Jul. 25, 1980

[30] Foreign Application Priority Data

Jul. 26, 1979 [JP] Japan ..... 54/103176[U]

[51] Int. Cl.[3] ..... H01C 10/30

[52] U.S. Cl. ..... 338/160; 338/184; 338/199

[58] Field of Search ..... 338/202, 160, 162, 174, 338/171, 164, 167, 184, 199, 118, 123, 124, 130, 334

[56] References Cited

U.S. PATENT DOCUMENTS

| | | | |
|---|---|---|---|
| 2,632,830 | 3/1953 | Aust et al. | 338/171 |
| 3,412,360 | 11/1968 | Colburn | 338/162 |
| 4,238,754 | 12/1980 | Schuberth et al. | 338/174 |

*Primary Examiner*—C. L. Albritton

*Attorney, Agent, or Firm*—Guy W. Shoup; Gerard F. Dunne

[57] ABSTRACT

A variable resistor provided with a click mechanism comprising a metallic bearing, a slide member, a holder to which the slide member is attached, a leaf spring being placed in a cavity formed in the bearing. A protrusion formed integrally with the leaf spring being resiliently contacted with plurality of grooves for click which are formed in a bottom of the bearing.

3 Claims, 4 Drawing Figures

VARIABLE RESISTOR WITH CLICK MECHANISM

BACKGROUND OF THE INVENTION

The present invention relates to a rotating type variable resistor, and more particularly to a rotating type variable resistor provided with an improved grounding mechanism and a click mechanism.

Generally, in the rotating type variable resistor, the shaft of the resistor is connected electrically to the chassis of the equipment to which the variable resistor is attached, and the shaft is grounded through the chassis. Therefore, conventionally there have been interposed between the metallic shaft and a metallic bearing a metallic ring for grounding purposes.

In the rotating type variable resistor, it may have a click mechanism for obtaining a clicking sound or distinct feel for stepwise rotation of the shaft. The click, mechanism is typically attached to a shaft protruding from a rear end of the variable resistor and comprises a click spring and a click plate having a plurality of grooves. Accordingly, the variable resistor provided with such a click mechanism has the click mechanism mounted on the protruded shaft, so that the variable resistor becomes large with disadvantage.

SUMMARY OF THE INVENTION

An object of the present invention is to provide a small variable resistor having a click mechanism.

Another object of the present invention is to provide a variable resistor having a click mechanism incorporated in the body thereof.

A further object of the present invention is to provide a variable resistor provided with a click mechanism which can be used as a grounding mechanism and can reduce the number of parts of the resistor.

Therefore, in accordance with the present invention, there is proposed a construction comprising a bearing made of metal material, a holder carrying slide contacts, a leaf spring being disposed within a cavity formed in the bearing, said cavity having a plurality of click grooves disposed therein which resiliently contacts a protrusion formed integraly with the leaf spring.

Further objects and advantages of the present invention will be more apparent from the drawings and the description thereof in connection with the below mentioned embodiment of the present invention.

PREFERRED EMBODIMENT OF THE INVENTION

Figure 1:
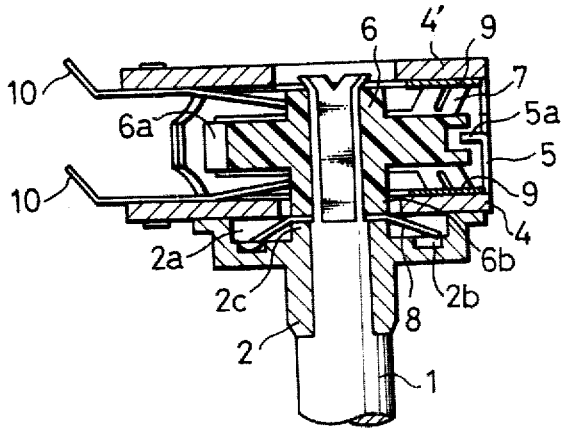
FIG. 1 is a sectional view of a variable resistor provided with a click mechanism of the present invention.
Figure 2:
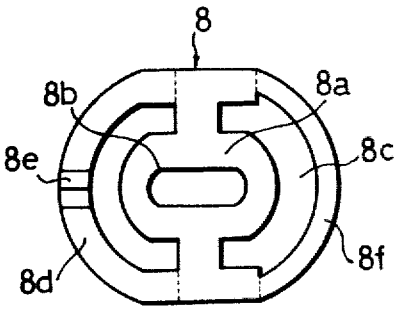
FIG. 2 is a plan view of a leaf spring in a variable resistor provided with a click mechanism of the present invention.

A reference numeral 8 is a leaf spring 8*a* a base portion thereof, 8*b* is a shaft opening of oval shape provided at a center of the leaf spring, 8*d* and 8*f* a pair of arcuate arms spaced from the base portion by slits 8*c*. In an end of one of the arms 8*d*, there is provided a protrusion 8*e*. The width dimension of the other arm 8*f* may be the same as that of the arm 8*d* but, preferably, is formed slightly smaller.

Figure 3:
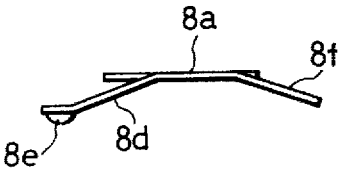
FIG. 3 is a side elevational view of a leaf spring shown in FIG. 2.
Figure 4:
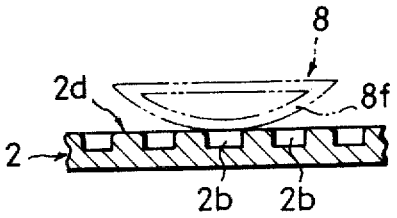
FIG. 4 is a side elevational view showing the sliding contact condition of the leaf spring sown in FIGS. 2 and 3 and the click mechanism.

Referring to FIGS. 1 and 3, a reference numeral 1 denotes a metallic shaft rotatably supported by a metallic bearing 2 made of zinc die casting and the like. Reference numerals 4 and 4' are a pair of insulating base plates fixed to a cover 5. The bearing 2 is also attached to the base plate 4 by an attaching leg (not shown) of the cover 5. A reference numeral 6 denotes a holder mounted on the shaft 1 and rotates together with the shaft and is made of an insulating material. On a confronting face thereof, a pair of slide contacts 7 and 7 are secured and slidably contacted with resistors 9 and 9 carried on the insulating base plates 4 and 4'. 6*a* is a protrusion for stopper which abuts against a protruding piece 5*a* cut from the cover 5 to restrict the rotation of the shaft 1. 10 and 10 are terminals. In the bearing 2, there is formed by molding a cavity 2*a* of circular shape coaxial with the axis of the shaft. On a bottom face of the cavity 2*a*, a plurality of radial grooves 2*b* are formed. The leaf spring 8 is mounted on the shaft 1 and held between annular protruding member 2*c* of the bearing 2 and a spacer 6*b* of the holder 6, as shown in the drawing. The leaf spring 8 rotates in the cavity 2*b* of the bearing during the rotation of the shaft 1. One of the arms 8*d* has the protrusion 8*e* engaged with and disengaged from the grooves 2*b* to obtain the clicking sound, while the other arm 8*f* slides on the surface 2*d* thereof without dropping into the click grooves 2*b* as illustrated in FIG. 4. The leaf spring 8 also functions to ground the shaft 1 and the bearing 2. In this case, since the width dimension of the arm 8*f* is smaller than that of the arm 8*d*, the load of the arm 8*d* is smaller than that of the arm 8*d* and in the case of passing on the click grooves 2*b*, roughness is not feld in touching for sliding.

What is claimed is:

1. A variable resistor comprising:

A casing having a resistor member therein;

A slide contact member being slidable on said resistor member;

A holder carrying said slide contact member being rotatably retained in said casing;

A metallic shaft for rotating said holder;

A metallic bearing for retaining said shaft; and means for obtaining a clicking during the rotation of said shaft, said click means comprises a cavity formed integrally with said bearing and having a plurality of radial grooves on a bottom thereof, and a disc shape leaf spring disposed within said cavity so as to resiliently contact with said grooves, said disc shape leaf spring being arranged to electrically connect said bearing with said shaft.

2. A variable resistor according to claim 1, wherein said leaf spring of disc shape comprises a base portion having a shaft opening for said shaft at a center thereof, a first arm of arch shape formed through a first slit at one side of a peripheral edge portion, and a second arm of arch shape confronting the first arm through said base portion and the second slit.

3. A variable resistor according to claim 2, wherein said first arm has a protrusion to engage with said plurality of grooves formed in the cavity of the bearing, and said second arm slidably contacts only the surfaces of said plurality of grooves.

* * * * *